US008579601B2

(12) United States Patent
Kim

(10) Patent No.: US 8,579,601 B2
(45) Date of Patent: Nov. 12, 2013

(54) MULTISTAGE DRY VACUUM PUMP

(76) Inventor: David Kim, Seoul (KR)

( * ) Notice: Subject to any disclaimer, the term of this patent is extended or adjusted under 35 U.S.C. 154(b) by 362 days.

(21) Appl. No.: 13/010,829

(22) Filed: Jan. 21, 2011

(65) Prior Publication Data

US 2012/0121442 A1 May 17, 2012

(30) Foreign Application Priority Data

Nov. 17, 2010 (KR) ..... 10-2010-0114296

(51) Int. Cl.
*F04B 25/00* (2006.01)

(52) U.S. Cl.
USPC ..... 417/251; 417/372; 417/410.4

(58) Field of Classification Search
USPC ..... 417/410.4, 366–374, 251; 418/5, 9, 85, 418/86, 92, 100, 101, 206.3, 201.1, 206.1
See application file for complete search history.

(56) References Cited

U.S. PATENT DOCUMENTS 4,995,796 A * 2/1991 Kambe et al. ..... 418/9
5,549,463 A 8/1996 Ozawa
5,921,755 A 7/1999 Eldridge
6,315,535 B1 * 11/2001 Hoshi et al. ..... 418/2
6,599,097 B2 7/2003 Kim
6,638,040 B2 10/2003 Wang et al.
7,278,839 B2 * 10/2007 Liu et al. ..... 418/9
7,611,340 B2 11/2009 Hwang et al.
2005/0019169 A1 * 1/2005 Kriehn et al. ..... 417/53

* cited by examiner

*Primary Examiner* — Peter J Bertheaud
*Assistant Examiner* — Dnyanesh Kasture
(74) *Attorney, Agent, or Firm* — Birch, Stewart, Kolasch & Birch, LLP

(57) ABSTRACT

The multistage dry vacuum pump is disclosed, in which it is possible to prevent a pump from being adhesively stuck, which problem occurs due to a difference in thermal expansions between a cylinder body and a rotor, by making thermal expansion conditions between a cylinder body and a rotor of a pump similar by concurrently cooling the cylinder body and the rotor of the pump. The gas passage for transferring gas compressed by each cylinder is provided at each cylinder body in a shape of surrounding an outer side of each cylinder, and a cooling water jacket for circulating cooling water is provided close to an outer side of the gas passage, and a communication passage is formed at a gas passage contacting with the cooling water jacket and is connected with an exhaust space of the cylinder.

13 Claims, 5 Drawing Sheets

MULTISTAGE DRY VACUUM PUMP

TECHNICAL FIELD

The present invention relates to a multistage dry vacuum pump, and in particular to a multistage dry vacuum pump in which a gas passage is formed coming into contact with an outer wall of a cylinder of a pump body, and cooling water is forced to circulate around an outer wall of the gas passage, and the gas passage communicates with an exhaust space of the cylinder, so the gas cooled in the gas passage is cooled together with the cylinder body and a rotor for thereby making the cylinder body and the rotor operate under an environment of similar temperatures and thermal expansion.

BACKGROUND ART

A conventional vacuum pump cooling technology is implemented in a structure that a cylinder body is directly cooled by forming a cooling water passage at an outer wall of a pump body cylinder, so a high temperate heat generating during a compress process in which a rotor intakes and exhausts into the interior of a cylinder is directly transferred to a rotor and is heated and thermally expanded, whereas the cylinder body is cooled by means of a cooling water circulating through a cooling water passage formed at an outer wall, so no thermal expansion occurs. So, there are formed a gap between each rotor and the cylinder and a gap between a pair of rotors in view of a thermal expansion which is different between the cylinder body and the rotor, both of which gaps are necessarily made bigger in order to prevent adhesive sticking of a pump. In this case, a high vacuum level cannot be easily obtained due to the bigger gaps or since an exhaust speed is lowered, it takes long time to reach a desired vacuum degree or it becomes impossible to reach a desired vacuum degree. Since it is impossible to control overheating of a rotor, the pump might be adhesively stuck in the course of operation by means of an over thermal expansion of the rotor as compared to the cylinder.

When a high vacuum pump having about $10^{-3}$ Torr of vacuum degree is needed in the conventional pump structure, two three-stage pumps are needed. Two pumps are connected without considering connecting more pumps in a multistage pump structure for the reasons that when the pump structure is made in at least three pump structure, an overheating problem due to the increase in the compression ratios and the difference of the thermal expansion of each member cannot be overcome. So, it is possible to a high vacuum degree when a six-stage cylinder structure by connecting two three-stage pumps in series. In this case, connecting two three-stage pumps leads to a long passage of working gas, and the prices of the pumps and maintenance cost significantly increase (about two times maintenance costs are needed when installing two pumps as compared to one pump).

DISCLOSURE OF THE INVENTION

Accordingly, it is an object of the present invention to provide a multistage dry vacuum pump in which it is possible to prevent a pump from being adhesively stuck, which problem occurs due to a difference in thermal expansions between a cylinder body and a rotor, by making thermal expansion conditions between a cylinder body and a rotor of a pump similar by concurrently cooling the cylinder body and the rotor of the pump, and a high vacuum degree can be obtained by obtaining an optimum gap design in the rotor and the cylinder, respectively, for thereby making the size of the pump smaller and significantly reducing the maintenance cost of the pump facilities.

To achieve the above objects, there is provided a multistage dry vacuum pump which comprises a plurality of multi-stage cylinder bodies which are formed in a multiple stage structure, so a gas compression ratio is getting increased more and more in a direction from a suction portion of gas to a discharge portion; a cylinder which is formed at each cylinder body; a pair of rotors which are installed in each cylinder and are engaged with each other and rotate; a main shaft and a driven shaft which rotate the pair of the rotors; a motor which rotate the main shaft; an inlet port which is connected to an external facility when the pair of the rotors rotate for guiding the gas to flow into the 1-stage cylinder; and an exhaust port which discharge the gas from the last cylinder to the outside, wherein a gas passage is formed at each cylinder body for transferring the gas compressed in each cylinder, with said gas passage surrounding an outer side of each cylinder, and a cooling water jacket for circulating cooling water is formed close to the outer side of the gas passage in a shape like surrounding the gas passage, and a communication passage is disposed at each gas passage contacting with the cooling water jacket and is made to communicate with an exhaust space of the cylinder.

With the above construction, the suction gas overheated by a compression heat generating during the compression process in which the gas is sucked and exhausted when a pair of the rotors rotate in the cylinder is cooled by means of a cooling water circulating close to the gas passage while the suction gas is transferred to the cylinder of the next stage via the gas passage, and the cooled gas enter the cylinder of the next stage and cools the rotors and the cylinder body, and the gas cooled via the gas passage is transferred to the next stage, during which part of the gas is inputted into an exhaust space of the cylinder via a communication passage for thereby increasing exhaust pressure, which leads to enhancing the circulation of the gas while cooling the rotors and the cylinder.

In the present invention, a cooling water jacket in which cooling water circulates is selectively formed at a cylinder body close to the side of an exhaust port for thereby performing cooling operation, so thermal balance is obtained with respect to the cylinder body at the side of the inlet in which a compression ratio is low.

In the present invention, a front cover and a rear cover are engaged at both sides of a cylinder body of each stage, and a cooling water jacket is provided at an outer side of the bearing, which supports a main shaft and a driven shaft, in order to circulate cooling water. A gear casing, which accommodates a pair of gears rotatably engaged with the main shaft and the driven shaft, is engaged at the front cover, with the cooling water jackets being equipped with a cooling system which communicates with the cooling water jacket of the cylinder body.

With the above construction, the heat occurring at the bearing, which supports the shafts, and the heat occurring at the gears can be cooled, and the lubricant oil in the gear casing can be also cooled.

In the present invention, the motor is installed at the gear casing, and a shaft seal member is provided at the main shaft along with the support bearing in order to prevent the lubricant oil from leaking via the main shaft. A sealing housing surrounding the shaft seal member and the support bearing is engaged to the gear casing, and the cooling water jackets, in which cooling water circulates, are formed at the outer wall of the sealing housing.

In the present invention, the rotor of the motor is integrally extended to the main shaft of the rotor or is directly engaged to the motor shaft which is separately formed, and the stator of the motor is fixed at the gear casing, and the cooling water jackets, in which cooling water circulates, are formed at the outer wall of the stator of the motor.

According to a preferred embodiment of the present invention, the cylinder body of the last stage contacting with the rear cover is equipped with two cylinders formed at both sides.

EFFECTS

The multistage dry vacuum pump according to the present invention has the following advantages.

1) The present invention is directed to concurrently cooling the multistage cylinder body of the pump apparatus and the rotors of the cylinder, in which a gas passage is formed in the cylinder body in a shape of surrounding the outer side of each cylinder, and a cooling water jacket is formed surrounding the outer side of the gas passages, and the cooling water circulates in each cooling water jacket for thereby cooling the gas passing through the gas passage based on a heat exchange method, and the cooled gas concurrently cools the cylinder body and the rotor for thereby making the cylinder body and the rotors have similar temperatures for thereby minimizing the differences of the thermal expansions between elements, so it is possible to make the gap between the rotor and the inner diameter of the cylinder and between a pair of the rotors smaller. For example, it is possible to obtain $10^{-3}$ Torr of vacuum degree by installing a five-stage cylinder structure, whereas the conventional pump apparatus can obtain $10^{-3}$ Torr of vacuum degree by connecting two pump apparatus of a three-stage cylinder structure in series. The present invention can obtain the performance by using one pump apparatus which can be obtained by two pump apparatus in the conventional art, so the size of the pump apparatus can be made smaller, while saving manufacturing cost at lot.

2) Part of the gas cooled via a communication passage connecting the gas passage of the cylinder body and the exhaust space of the cylinder is fed back to the cylinder for thereby increasing exhaust pressure while promoting the discharge of gas, which results in enhancing a reach vacuum degree and exhaust speed while concurrently cooling the cylinder body and the rotor. So, it is possible to make a stable pump environment with the aid of similar thermal expansion conditions between elements.

3) The cooling water jackets are formed at the front cover, the rear cover, the sealing housing and the driving motor, respectively, so the cooling water circulating in each water jacket during the operation of the pump apparatus cools the heat from the bearing, gear, lubricant oil, shaft seal oil and motor for thereby enhancing the life spans of parts.

4) The size of the pump can be reduced by directly connecting the driving motor to the pump for thereby significantly reducing the installation space and saving manufacturing cost by reducing the number of parts.

5) The cylinders can be made in a three-stage structure, a four-stage structure or a five-stage structure depending on the reach vacuum degree of the pump apparatus. The parts made via the same manufacturing process can be applied to various models of products, which lead to saving manufacturing cost, and it is possible to select a desired pump apparatus depending on a needed vacuum degree.

6) The cylinder body of the last stage contacting with the rear cover is equipped with two cylinders for thereby saving manufacturing cost by decreasing the number of parts.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

The present invention can be implemented in detailed with the following embodiments. Such embodiments are provided for only illustrative purpose to an extent that those skilled in the art can implement, not limiting the scope of the claims of the present invention. So, the present invention is not limited to the embodiments to be descried, and it is obvious that any part or modification obtained as a result of the present invention will belong to the present invention. The preferred embodiments of the present invention will be described with reference to the accompanying drawings. The multistage dry vacuum pump will be described in details.

Figure 1:
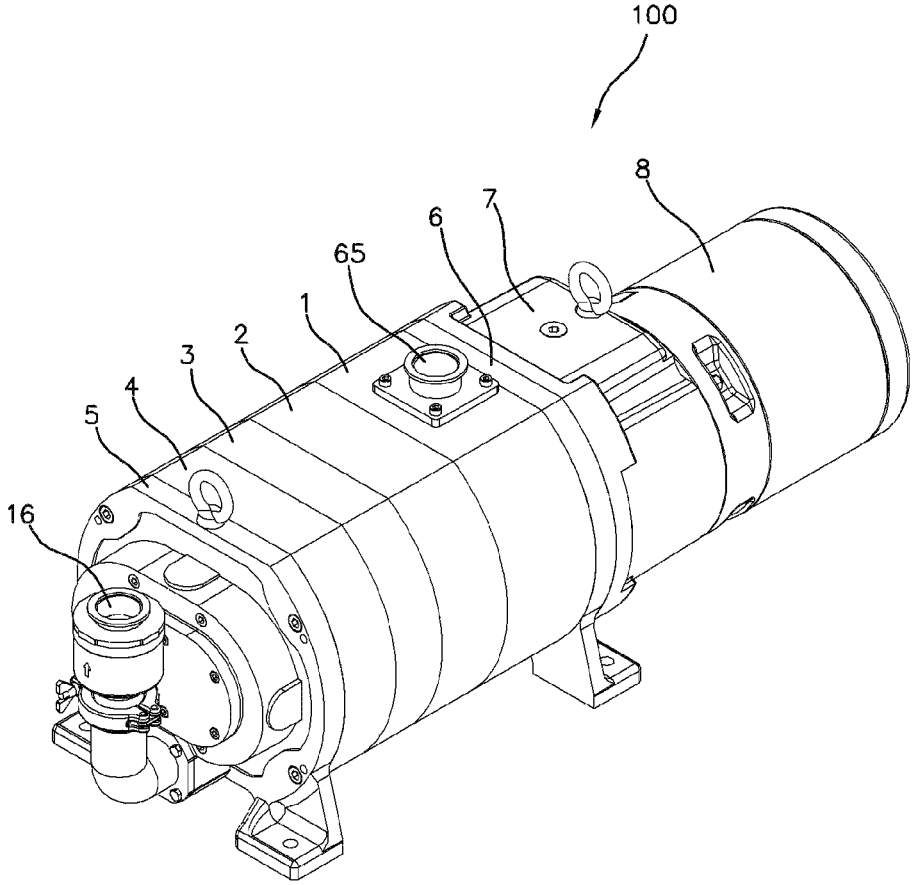
FIG. 1 is a perspective view illustrating an outer look of a multistage vacuum pump according to the present invention.
Figure 2:
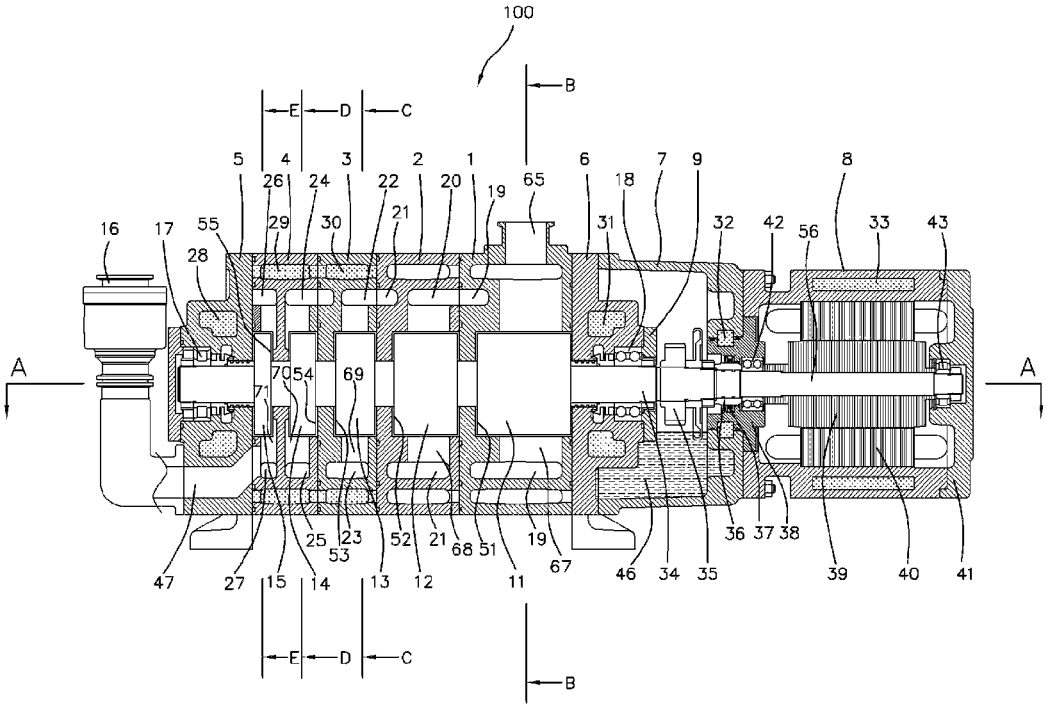
FIG. 2 is a front cross sectional view illustrating a multistage vacuum pump according to the present invention.
Figure 3:
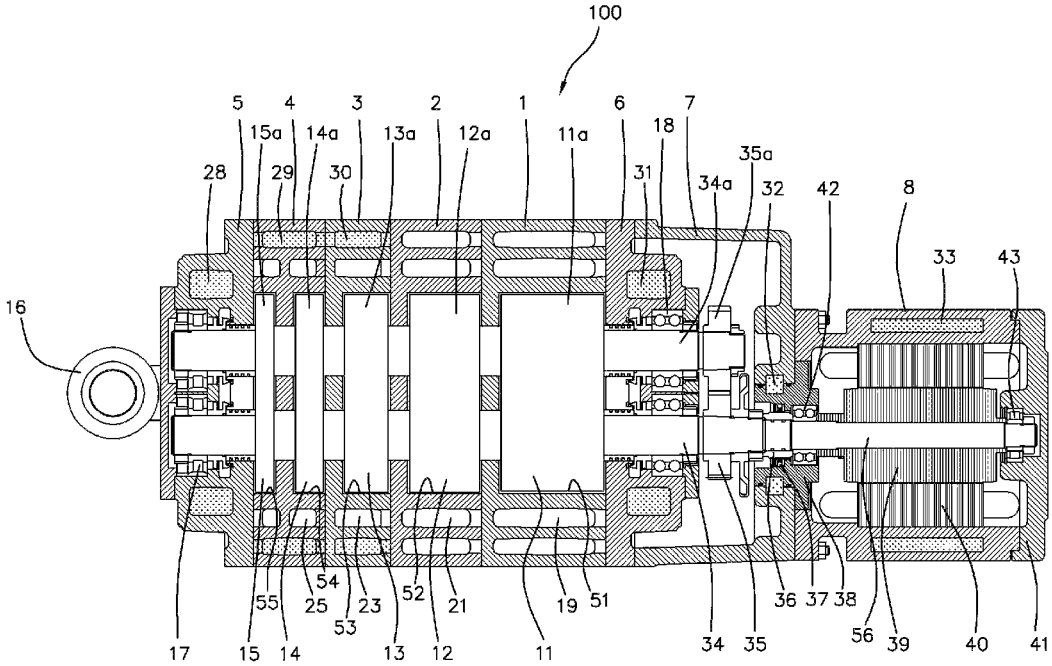
FIG. 3 is a cross sectional view taken along line A-A of a multistage vacuum pump according to the present invention.
Figure 4:
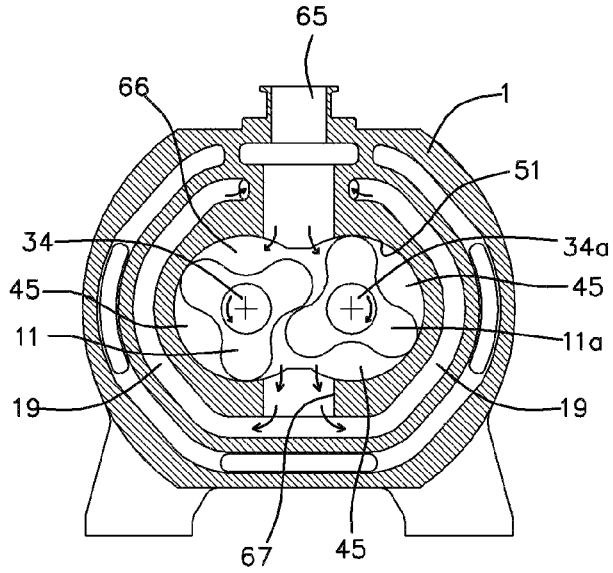
FIG. 4 is a cross sectional view taken along line B-B of a multistage vacuum pump according to the present invention.

As shown in FIGS. 1 through 3, the vacuum pump apparatus 100 according to the present invention comprises a multistage cylinder body formed of a 2-stage through 6-stage, preferably, 3-stage through 5-stage. In the preferred embodiment of the present invention, there are provided four cylinder bodies 1, 2, 3 and 4 (cylinder blocks) arranged in series. As shown in FIG. 4, each cylinder bodies 1, 2, 3 and 4 comprises 1-stage through 5-stage cylinders 51, 52, 53, 54 and 55 in which the empty space of the center portion looks like a peanut when seeing their cross sections. Each cylinder is designed to have a compression ration which is getting increased from the 1-stage cylinder 51 to the 5-stage cylinder 55 (corresponding to a lower end side or downstream) which is a discharge port of the gas, so the lengths of each cylinder 51 to 55 are getting smaller from the 1-stage to 5-stage. The number (four) of the cylinder bodies and the number (5) of the cylinders are not in consistent with each other because the 4-stage cylinder 54 and the 5-stage cylinder 55 are formed together at both sides of the 4-stage cylinder body 4.

As shown in FIG. 3, in the vacuum pump apparatus 100, two shafts 34 and 34*a* horizontally pass through the cylinders 51, 52, 53, 54 and 55 in sequence, and the rotors 11, 12, 13, 14 and 15 are sequentially installed at the pump main shaft 34. The rotors 11*a*, 12*a*, 13*a*, 14*a* and 15*a* are sequentially installed at the pump driven shaft 34*a*, so the pairs of the rotors engaged like gears rotate in each cylinder (for easier understanding, it has been expressed like the cylinder and the cylinder body are separate from each other, but the cylinder means a peanut shaped space for accommodating a pair of rotors which are engaged with each other and rotate in the cylinder body).

The pairs of the rotors 11, 11*a*, 12, 12*a*, 13, 13*a*, 14, 14*a* and 15, 15*a* are sequentially accommodated in each cylinder 51, 52, 53, 54 and 55, respectively. A rear cover 5 forming a wall surface is engaged in the 5-stage cylinder 54 in the 4-stage cylinder body 4, and a front cover 6 is engaged at the 1-stage cylinder body 1, and the gear casing 7 is engaged to the front cover 6, and the motor 8 is engaged to the gear casing 7.

When the motor 8 gets started, the pump shaft 34 and the gear 35 passing through the gear casing 7 rotate, and at the same time, the pump driven shaft 34*a* rotates in the reverse direction by the gear 35*a* engaged with the gear 35. A pair of the rotors 11, 11*a*~15, 15*a* installed in each cylinder 51~55 rotate in the reverse direction while being engaged with each other, so gas is sucked via the suction port 65 connected to a gas facility (not shown) and is exhausted via the exhaust port 16.

Figure 5:
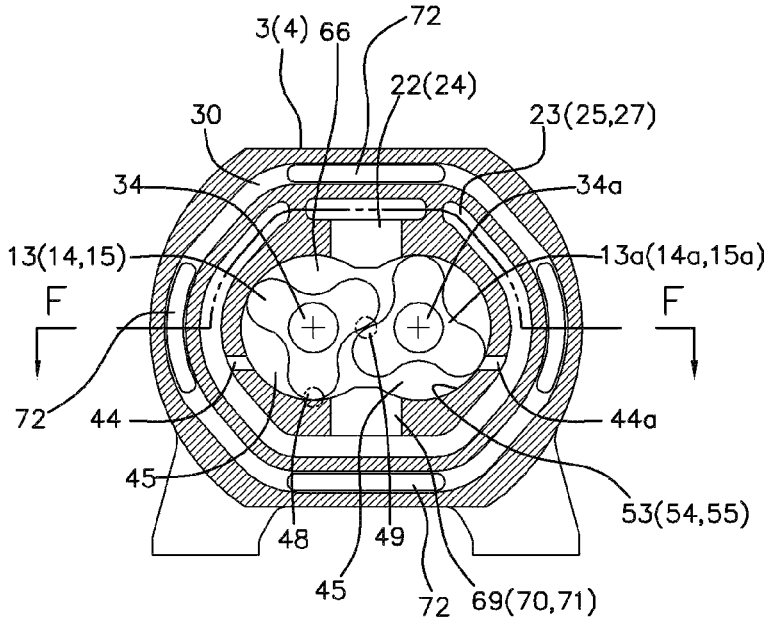
FIG. 5 is a side cross sectional view of a multistage vacuum pump according to the present invention, wherein the side cross sections taken along line C-C, D-D and E-E of FIG. 2 are all same.
Figure 6:
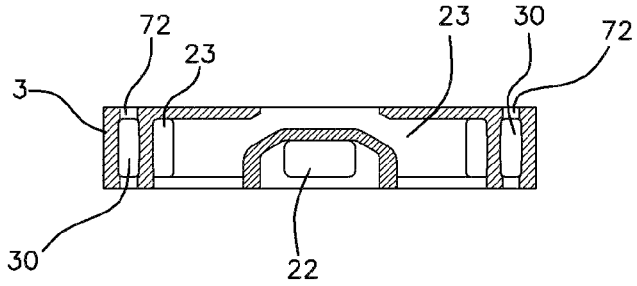
FIG. 6 is a cross sectional view taken along line F-F taken by cutting a third cylinder body of FIG. 5 along a gas passage according to the present invention.

The way for sucking and exhausting gas in the pump apparatus 100 will be described with reference to FIGS. 4 and 5. As the pump shafts 34 and 34*a* rotate, as shown in FIG. 4, the pair of the rotors 11 and 11*a* rotate as indicated by the arrow, and gas is forcibly sucked into the 1-stage cylinder 51 via the gas facility (not shown) via the suction port 65 communicating with the 1-stage cylinder 51, and the sucked gas gathers in the space 66 of the upper side formed close to the cylinder 51 and changes its position as the rotors 11 and 11*a* rotate, and the gas is transferred to the exhaust space 45 of the lower side and is pushed toward the lower side of the gas passage 19 via the passage 67 of the lower side as shown in FIG. 4, and the gas inputted into the gas passage 19 moves to the upper side of the gas passage 19 by means of the continuing pushing pressure of the rotors 11 and 11*a* and the suction forces of the rotors 12 and 12*a* of the neighboring cylinder and passes through the upper side suction port 20 of the neighboring 2-stage cylinder body 2 communicating with the upper side of the gas passage 19 and is inputted into the 2-stage cylinder 52. The continuously inputting gas gathers in the spaces 66 and 45 formed by means of the rotors 12 and 12*a* and the cylinder 52 and is compressed while it is being moved, and the compressed gas is transferred to the upper side via the lower side of the gas passage 21 via the passage 68. As shown in FIG. 5, the gas is inputted into the suction port 22 formed at the 3-stage cylinder body 3.

The gas sucked into the 3-stage cylinder 53 via the suction port 22 of the upper side is pushed toward the gas passage 23 via the passage 69 with the aid of the rotations of the rotors 13 and 13*a* and is inputted into the suction port 24 of the 4-stage cylinder body 4. The gas sucked into the 4-stage cylinder 54 via the suction port 24 is inputted to the suction port 26 of the 5-stage cylinder 55 of the next step along the gas passage 25 via the passage 70 with the aid of the rotation of the rotors 14 and 14*a*. The gas sucked into the 5-stage cylinder 55 via the suction port 26 is finally compressed by means of the rotors 15 and 15*a* and is exhausted. The compressed gas is exhausted to the outside of the apparatus 100 via the exhaust port 16 communicating with the exhaust passage 27 through the passage 71.

The lengths of the cylinders 51 to 55 of each stage of the pump apparatus 100 are getting decreased, so when the gas is sucked by the rotors 11 and 11*a* in the 1-stage cylinder 51 and is transferred in sequence to the 5-stage cylinder 55 via the cylinders 52 to 54 of each stage, the compression ratio of the gas gradually increases due to the decreases of the cylinder volumes. So, the temperatures of the cylinder bodies 1 to 4 and the rotors 11, 11*a* to 15, 15*a* gradually increase. The heat occurring when the gas is compressed in the cylinders 51 to 55 is transferred to the cylinder bodies and the rotors. The high temperature heat transferred to the cylinder bodies and the rotors might worsen the durability of the elements, which leads to decreasing pump performance.

In order to overcome the above problem, the cooling structure of the cylinder body (block) of the conventional pump is designed so that cooling water can flow via the outer wall for thereby directly cooling the cylinder. In this case, the cylinder body can be cooled by cooling water and remains cooled down, but the rotor increases its temperature as it continues to contact with compressed high temperature heat. So, there is a big difference in the thermal expansion between the cylinder body and the rotor due to the above environment, which leads to a thermal adhesion of the pump.

In order to overcome the above problems occurring due to thermal expansion differences, the present invention adapts a structure in which the cylinder body and the inner space of the cylinder of the pump apparatus can be concurrently cooled. The gas passages 19, 21, 23, 25 and 27 are made at the cylinder bodies 1, 2, 3 and 4 around each cylinder 51 to 55. The cooling water jackets 29 and 30 surrounds close to a gas passage of the downstream side, in which high temperature gas circulates, among the gas passages, namely, the gas passages 23, 25 and 27 formed surrounding the 3-, 4- and 5-stage cylinders 53, 54 and 55, so the cold cooling water exchanges heats with gas while passing through the cooling water jackets 29 and 30 (here, the cylinder bodies 1 and 2, which have small heat generations since compression ratios are low, do not perform cooling operations), and the gas passages 23, 25 and 27 close to the cooling water jackets 29 and 30 in which cooling water actually circulates communicate with the exhaust spaces 45 of the cylinders 53, 54 and 55 via the communication passages 44 and 44*a*. When the gas is transferred to the next stage via the gas passages 23, 25 and 27, the gas cooled in the gas passages 23, 25 and 27 by means of the cooling water circulating in the cooling water jackets 29 and 30 cools the cylinder bodies 3 and 4, and the cooled gas is inputted into the cylinders 53, 54 and 55, respectively, for thereby concurrently cooling the rotors 13, 13*a*, 14, 14*a* and 15, 15*a*. At the same time, part of the gas cooled by means of a heat exchange with the cooling water while being transferred via the gas passages 23, 25 and 27 is inputted into the exhaust spaces 45 of the cylinders 53, 54 and 55 via the communication passages 44 and 44*a* (which are formed at three cylinders 53, 54 and 55 of the cylinder bodies 3 and 4 in which cooling water circulates) connecting the interiors of the cylinders 53, 54 and 55 for thereby increasing exhaust pressure, which leads to promoting smooth discharge of gas and enhancing vacuum degree. The cooling operation of each rotor is performed by the cooling gas inputted via the communication paths 44 and 44*a* while helping make the cylinder bodies 3 and 4 the rotors 13, 13*a*, 14, 14*a* and 15, 15*a* operate under similar environments. The unbalances of the conventional thermal expansion are overcome by making the related elements have similar level thermal expansions. As shown in FIG. 5, reference numeral 7 represents a hole for communicating the cooling water jacket 29 and the cooling water jacket 30.

One of the major features of the present invention lies in that the cooling water circulating via the cylinder body does not circulate all the cylinder bodies, but circulates via one the 4-stage cylinder body 4 or the 4-stage and 3-stage cylinder bodies 4 and 3 in which heat is generated a lot because compression ratios are high. Namely, the cooling water does not circulate in the 1-stage and 2-stage cylinder bodies 1 and 2 in which compression ratios are relatively lower. So, in the present invention, it is possible to minimize the differences in the thermal expansions which occur due to temperature unbalance by making the temperatures of the cylinder bodies 1 to 4 and the rotors 11, 11*a* to 15, 15*a* balanced for thereby preventing distortions of apparatus. In particular, it is possible to make the gap 48 of FIG. 5 formed between an outer diameter of each rotor and an inner diameter of each cylinder and the gap 49 of FIG. 5 formed between a pair of engaged rotors and the rotors smallest for thereby improving the structural problems that the vacuum degree of the pump is worsened when the gas moves in reverse direction via the above gaps 48 and 49.

As described earlier, the 4-stage cylinder body 4 is designed to have the function of two cylinders 54 and 55 by using one cylinder body for thereby reducing the number of parts and simplifying the construction. In the drawings, it has been constructed that the cooling water jacket is formed at the 1-stage and 2-stage cylinder bodies 1 and 2, but it can be designed so that the present invention can be adapted to the products having different cylinder stages. In the present invention, the cooling water does not circulate in the cooling jackets formed in the cylinder bodies 1 and 2.

The cooling water jacket 28 is formed around the outer side of the bearing 17 of the rear cover 5 for thereby circulating cooling water for thereby cooling the heat of the bearing 17 and the heat of the 4-stage cylinder 54, and the gas exhausted to the outside via the exhaust passage 47 is cooled and discharged.

The cooling water jacket 31 is formed around the outer side of the bearing 18 of the front cover 6 for thereby circulating cooling water for thereby cooling the heat of the bearing 18 and the heat of the gears 35 and 35*a*, and the life span of the bearing and the gear can be prolonged by cooling the lubricant oil 46 which is applied for lubrication operations of the gears and the bearing.

The shaft seal member 37 is provided inside the sealing housing 38 assembled to the gear casing 7 for thereby obtaining a sealing operation for sealingly isolating the interior of the vacuum gear casing 7 and the interior of the motor 6 in an atmospheric state. At this time, the cooling water jacket 32 is made around the outer side of the sealing housing 38 for thereby cooling the friction heat occurring when the shaft seal member 37 rotates and the heat occurring at the rotor unit 39 of the motor, so prolonging the life span of the shaft seal member 37.

In addition, in the conventional pump apparatus, the pump body and the motor needs a flexible coupling for a connection of the motor shaft and the pump main shaft, and a motor flange is needed to fix the motor and the pump body, so the size of the pump apparatus increases, and the structure is complicated. However, in the present invention, when connecting the motor 8 to the pump body, the motor 8 is assembled to the gear casing 7 for thereby decreasing the size of the pump while reducing the number of parts for making the structure simplified. The rotor unit 39 of the motor 8 is fixedly engaged to the pump main shaft 34 (the pump main shaft corresponds to a single body with the motor shaft 56), and the stator 40 of the motor 8 is fit over the outer side of the rotor unit 39, and the front end portion of the housing of the motor 8 is inserted into the outer diameter of the sealing housing 38 and is fixed to the gear casing 7 by using bolts, with its rear end being fixed to the rear cover 41, so the motor can be directly engaged to the pump body. The rotor unit 39 of the moor 8 is supported by the bearings 42 and 43 for thereby preventing any movements during the rotation, and the cooling water jacket 33 is made around the stator 40 of the motor 8 for thereby cooling the heat of the motor by means of cooling water, whereby it is possible to reduce noises as compared to the conventional air cooling system which uses cooling fan, and the pump apparatus can operate silently.

Circulating cooling water in the pump apparatus is performed in the order of the rear cover 5, the cylinder bodies 4 and 3, the front cover 7, the sealing housing 38 and the motor 8. When cooling water is supplied to the cooling water jacket 28 of the rear cover 5 via the connection pipes from an external tank, the cooling water sequentially passes through the cooling water jackets 29 and 30 of the cylinder bodies 4 and 3 for thereby cooling the gas passing through the gas passages 23, 25 and 27 by heat exchange method, and the cooling water is inputted into the cooling water jacket 31 of the front cover 6 via separate pipes (not shown) which skip the 1-stage and 2-stage cylinder bodies 1 and 2, and the cooling water is inputted into the cooling water jacket 32 of the sealing housing 38 and is inputted into the cooling water jacket 33 of the motor 8 via separate pipes for thereby cooling the motor, and then the cooling water goes back to the external tank via the separate pipes connected to the cooling water jacket 33. At this time, the cooling water circulating in the order of the rear cover 5, the cylinder bodies 3 and 4, the front cover 6, the sealing housing 38 and the motor 8 enters in the direction of the upper side and comes out from the lower side, and the cooling water coming from the upper side is connected to the lower side of the next member, which makes it possible to more efficiently cool.

As described above, the embodiments of the multistage dry vacuum pump according to the present invention has been disclosed for only illustrative purposes.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A multistage dry vacuum pump, comprising:

a first stage cylinder body, the first stage cylinder body including a first stage cylinder and a pair of first stage rotors located in the first stage cylinder, the first stage rotors being rotatable with respect to each other;

a final stage cylinder body, the final stage cylinder body including a final stage cylinder and a pair of final stage rotators located in the final stage cylinder, the final stage rotors being rotatable with respect to each other, the first stage cylinder body and the final stage cylinder body being arranged in series such that a gas compression ratio increases as gas moves from the first stage cylinder body to the final stage cylinder body;

a main shaft configured to rotate one of the first stage rotors and one of the final stage rotors;

a driven shaft configured to rotate the other of the first stage rotors and the other of the final stage rotors;

a motor to rotate the main shaft;

an inlet port connectable between an external facility and the first stage cylinder body to guide gas flow into the first stage cylinder; and an exhaust port connected to the final stage cylinder body to discharge gas, wherein the first stage cylinder body includes a gas passage formed at an outer side of the first stage cylinder, the gas passage of the first stage cylinder body being configured to transfer compressed gas from an exhaust space of the first stage cylinder, wherein the final stage cylinder body includes a gas passage formed at an outer side of the final stage cylinder, the gas passage of the final stage cylinder body being configured to transfer compressed gas from an exhaust space of the final stage cylinder, wherein only one of the first stage cylinder body and the final stage cylinder body includes a cooling water jacket formed adjacent an outer side of the gas passage of the corresponding cylinder body to surround the gas passage of the corresponding cylinder body, and wherein said only one of the first stage cylinder body and the final stage cylinder body includes a communication passage connecting the gas passage of the corresponding cylinder body to the corresponding cylinder such that compressed gas cooled by the cooling water jacket is returned to the exhaust space of the corresponding cylinder.

2. The pump of claim 1, further comprising a plurality of intermediary stage cylinder bodies arranged between the first stage cylinder body and the final stage cylinder body, each of the intermediary stage cylinder bodies including:

an intermediary stage cylinder;

a pair of intermediary stage rotors located in the intermediary stage cylinder, the intermediary stage rotors being rotatable with respect to each other; and a gas passage formed at an outer side of the intermediary stage cylinder, the gas passage of the intermediary stage cylinder body being configured to transfer compressed gas from an exhaust space of the intermediary stage cylinder.

3. The pump of claim 2, wherein said only one of the first stage cylinder body and the final stage cylinder body is the final stage cylinder body, wherein one of the intermediary stage cylinder bodies includes a cooling water jacket formed adjacent an outer side of the gas passage of the corresponding intermediary cylinder body to surround the gas passage of the corresponding intermediary cylinder body, and wherein said one of the intermediary stage cylinder bodies includes a communication passage connecting the gas passage of the corresponding intermediary cylinder body to the corresponding intermediary cylinder such that compressed gas cooled by the cooling water jacket of the corresponding intermediary cylinder body is returned to the exhaust space of the corresponding intermediary cylinder.

4. The pump of claim 3, wherein said one of the intermediary stage cylinder bodies is adjacent said final stage cylinder body.

5. The pump of claim 4, wherein the cooling water jacket of the final stage cylinder body and the cooling water jacket of said one of the intermediary stage cylinder bodies are configured to achieve a thermal balance between the first stage cylinder body and the final stage cylinder body.

6. The pump of claim 4, further comprising:

a front cover connected to the first stage cylinder body, the front cover including front cover bearings to rotatably support the main shaft and the driven shaft and a front cover cooling water jacket formed adjacent to outer sides of the front cover bearings;

a rear cover connected to the final stage cylinder body, the rear cover including rear cover bearings to rotatably support the main shaft and the driven shaft and a rear cover cooling water jacket formed adjacent to outer sides of the rear cover bearings, wherein the front cover cooling water jacket and the rear cover cooling water jacket are connected to the cooling water jacket of the final stage cylinder body or the cooling water jacket of the corresponding intermediary cylinder body by a cooling system.

7. The pump of claim 6, further comprising a gear casing connected to the front cover, the gear casing including a pair of gears rotatably connected to the main shaft and the driven shaft.

8. The pump of claim 7, wherein the motor includes a motor shaft operably connected to the main shaft, and wherein the motor is mounted to the gear casing by a seal housing, the seal housing including a shaft seal member to surround the main shaft and a seal housing cooling water jacket.

9. The pump of claim 8, wherein the motor includes a rotor unit mounted on the motor shaft and a stator fixed to the gear casing, and wherein a motor cooling water jacket is formed adjacent an outer side of the stator.

10. The pump of claim 9, wherein the final stage cylinder body includes another cylinder located between the first stage cylinder and the final stage cylinder and another gas passage formed at the outer side of the final stage cylinder, said another gas passage of the final stage cylinder body being configured to transfer compressed gas from an exhaust space of said another stage cylinder.

11. The pump of claim 10, wherein the cooling water jacket of the final stage cylinder body is formed adjacent to an outer side of said another gas passage of the final stage cylinder body to surround said another gas passage of the final stage cylinder body.

12. The pump of claim 3, wherein the final stage cylinder body includes another cylinder located between the first stage cylinder and the final stage cylinder and another gas passage formed at the outer side of the final stage cylinder, said another gas passage of the final stage cylinder body being configured to transfer compressed gas from an exhaust space of said another stage cylinder.

13. The pump of claim 12, wherein the cooling water jacket of the final stage cylinder body is formed adjacent to an outer side of said another gas passage of the final stage cylinder body to surround said another gas passage of the final stage cylinder body.

* * * * *